United States Patent [19]

Kaartinen

[11] 3,942,938

[45] Mar. 9, 1976

[54] COMBUSTION SYSTEM FOR PREPARING RADIOACTIVE SAMPLES AND THE LIKE

[75] Inventor: Niilo H. Kaartinen, Kuusisto, Finland

[73] Assignee: Packard Instrument Company, Inc., Downers Grove, Ill.

[22] Filed: Dec. 6, 1974

[21] Appl. No.: 530,293

[52] U.S. Cl. ..... 431/3; 23/230 PC; 23/253 PC; 23/277 C

[51] Int. Cl.[2] ..... F23D 11/38; G01N 31/12

[58] Field of Search ..... 431/3, 121, 158; 23/230 PC, 253 PC, 277 C; 252/301.1

[56] References Cited

UNITED STATES PATENTS

| | | | |
|---|---|---|---|
| 3,485,565 | 12/1969 | Kaartinen | 431/3 |
| 3,542,121 | 11/1970 | Kaartinen | 165/1 |
| 3,682,598 | 8/1972 | Kaartinen | 23/230 PC |
| 3,830,628 | 8/1974 | Kaartinen | 23/230 PC |
| 3,849,069 | 11/1974 | Kaartinen | 23/230 PC |

*Primary Examiner*—Kenneth W. Sprague
*Attorney, Agent, or Firm*—Wolfe, Hubbard, Leydig, Voit & Osann, Ltd.

[57] ABSTRACT

A combustion system for combusting materials containing radioactive nuclides to permit recovery of the radioactive nuclides. The system comprises a primary combustion zone in which the sample material is initially combusted and from which the combustion products are continuously exhausted. The exhaust products from this primary combustion zone are passed through a secondary combustion zone in which uncombusted materials in the exhaust products are combusted. In the secondary combustion zone, the exhaust products from the primary zone are directed in a helical path so that centrifugal forces drive the gases and any particulate matter entrained therein toward the walls of the secondary zone while intimately mixing the materials with each other to achieve rapid and complete combustion. The secondary combustion zone preferably comprises a helical tube which is heated by passing an electric current through the walls thereof. The helical path preferably has a radius of curvature of less than about 1.5 inches and is preferably heated to a temperature of at least 900°C. to achieve the desired condition.

16 Claims, 3 Drawing Figures

COMBUSTION SYSTEM FOR PREPARING RADIOACTIVE SAMPLES AND THE LIKE

DESCRIPTION OF THE INVENTION

The present invention relates to combustion systems for combusting materials containing radioactive nuclides to permit recovery of the radioactive nuclides and, more particularly, to combustion systems of the type used in laboratory equipment for separating radioactive nuclides from samples of tissue and the like.

In recent years, flame combustion systems have become increasingly popular for the preparation of samples for radioactive nuclide studies. Combustion systems of this general type have been disclosed in my U.S. Pat. Nos. 3,485,565; 3,542,121; 3,682,598; 3,761,228; and 3,830,628 and in my pending applications Ser. Nos. 728,939, filed May 14, 1968, now abandoned, and 264,379, filed June 19, 1972, now U.S. Pat. No. 3,849,069. Although these systems have been sold commercially for several years now, they still require time-consuming treatment or preparation of the sample materials before they are combusted and/or the use of extremely small samples of certain sample materials in order to achieve adequate combustion. For example, fatty tissue samples from pig carcasses and the like must be limited in size and mixed with a carrier material such as cellulose powder to achieve complete combustion. Without complete combustion, recovery of the radioactive nuclides is incomplete, resulting in undesirable "memory" (retention of radioactive material) in the apparatus and consequent spillover errors which adversely affect the analytical results.

It is, therefore, a primary object of the present invention to provide an improved combustion system which achieves complete combustion of even those sample materials that are difficult to combust completely, and in a very short time interval. In this connection, a related object of the invention is to provide such a combustion system which achieves such rapid and complete combustion without utilizing a catalytic packing or filling, thereby avoiding the high back pressure and slow heat transfer problems that often result from the use of such catalytic materials, as well as the problem of poisoning the catalysts.

One of the important specific objects of this invention is to provide such an improved combustion system which is capable of completely combusting difficult samples (e.g., fatty samples, diluted samples, samples with large surface areas, volatile samples, diluted gas, pyrolysis products) efficiently without any prior treatment or preparation of the sample material.

It is another object of the invention to provide such an improved combustion system which, in combination with commercially available recovery systems, is capable of achieving radioactive nuclide recoveries in excess of 99% with memories attributable to pyrolysis products reduced several orders of magnitude, and with overall memories reduced an order of magnitude, below the lowest memories attainable in prior combustion systems.

Another object of the invention is to provide such an improved combustion system which achieves high heat transfer rates and such complete combustion that the exhaust products are essentially free of smoke, soot or other particulate combustible matter.

Still another object of the invention is to provide such an improved combustion system which utilizes compact and simple equipment so that it can be efficiently manufactured at a reasonable cost, and so that it can be contained in a relatively compact housing.

A further object of the invention is to provide an improved combustion system of the type described above which has a long operating life.

Yet another important object of the invention is to provide such an improved combustion system which can be fabricated without any joints in the combustion zones.

Other objects and advantages of the invention will be apparent from the following detailed description together with the accompanying drawings, in which.

Figure 1:
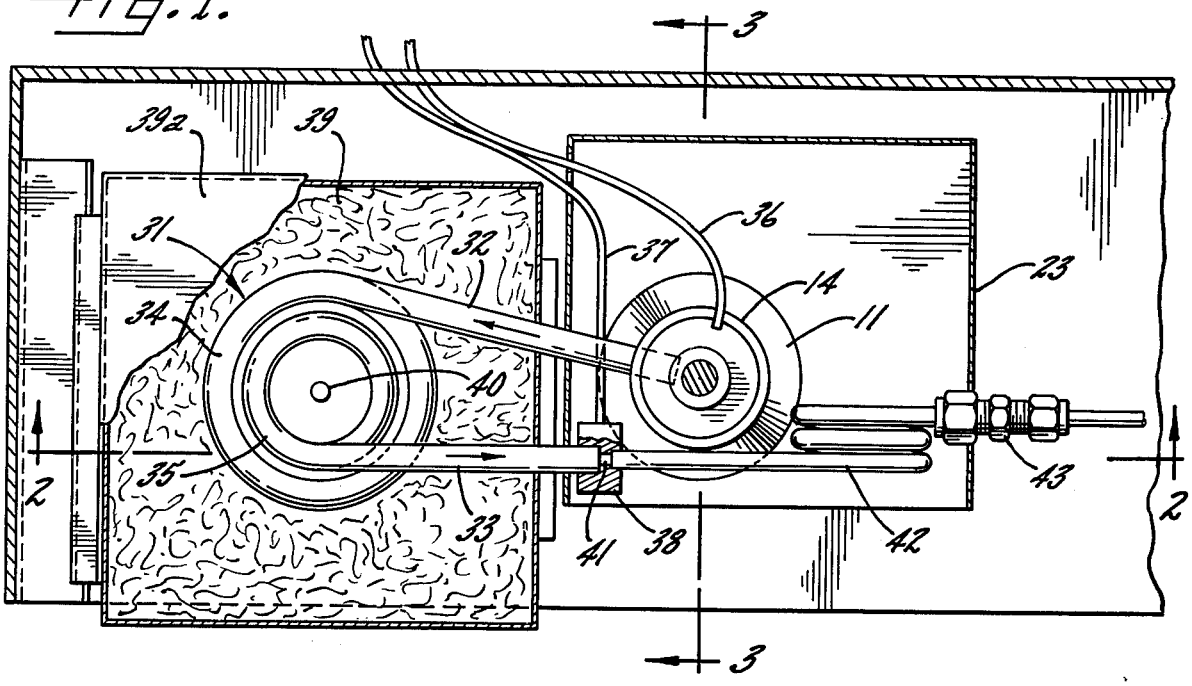
FIG. 1 is a top plan view of a combustion system embodying the invention, with fragments broken away or shown in section for clarity.
Figure 3:
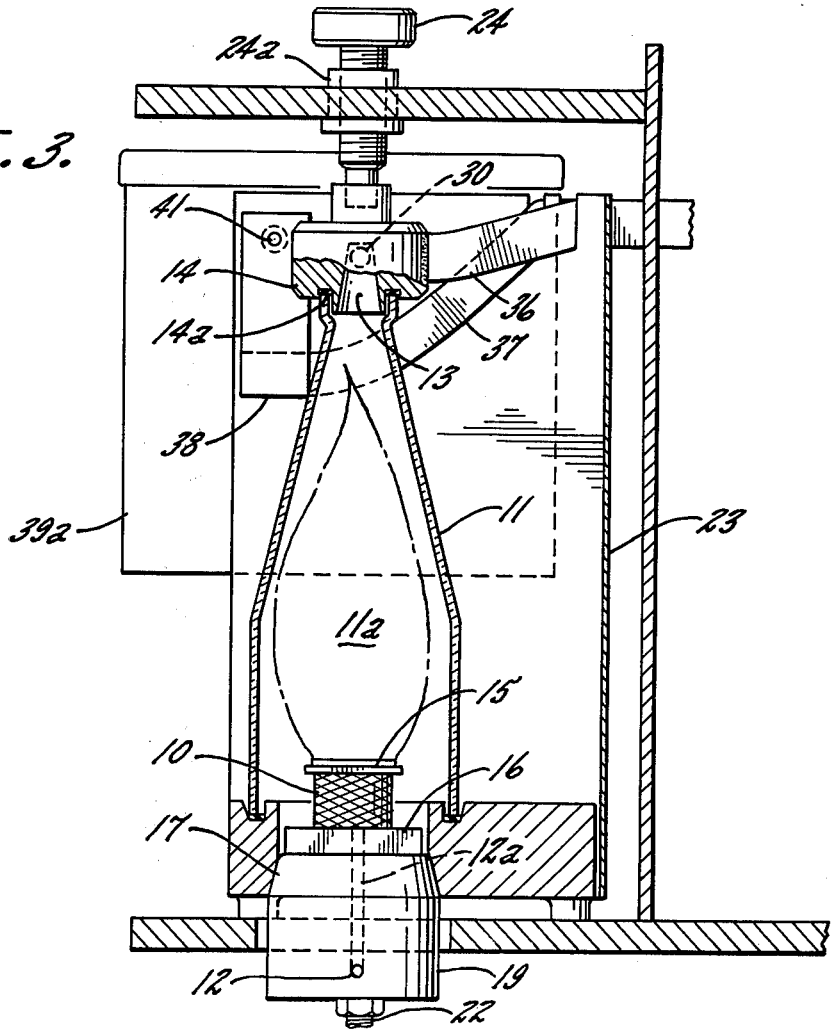
FIG. 3 is an end elevation partially in section, of the system shown in FIG. 1.

While the invention will be described in connection with a certain preferred embodiment, it will be understood that it is not intended to limit the invention to that embodiment. On the contrary, it is intended to cover all alternatives, modifications, and equivalents as may be included within the spirit and scope of the invention as defined by the appended claims.

Turning now to the drawings, there is illustrated a combustion system for use in the preparation of samples for radioactive nuclide tracer studies, such as studies involving tissue distribution and residue levels of drugs in plants and animals. In the preparation of such samples, the sample material containing the radioactive nuclide tracer, such as plant or animal tissue, is combusted to convert the carbon in the sample material to carbon dioxide and the hydrogen to water, and the radioactive nuclide tracer is then recovered from the resulting combustion products. The details of the radioactive nuclide recovery are described in my aforementioned patents and applications and will not be repeated here. Suffice it to say that the combustion unit is followed by various units, interconnecting conduits, and associated apparatus for treating the gaseous combustion products to separate and effect recovery of selected radioactive nuclides. The apparatus in this instance is particularly adapted for recovery of $^{3}H$ and $^{14}C$ tracers.

At the beginning of a combustion cycle, material containing the radioactive nuclide tracers, in either solid or liquid form, is placed in a sample basket 10, and the operator pushes a start button for a preprogrammed pneumatic control unit (not shown) which positions the basket 10 within a primary combustion zone 11*a* formed by a glass flask 11 which is open at both ends. Combustion oxygen, preferably pure oxygen, is admitted to the flask 11 through an oxygen inlet 12. The radioactive nuclide containing material is quickly combusted, and the resulting combustion products pass upwardly through the primary combustion zone 11a and exit through an exhaust port 13 formed by a fitting 14 sealed to the top of the flask 11. As used herein, the term "combustion" as applied to the primary combustion zone refers not only to flame combustion but also to oxidation, pyrolysis, vaporization or any other process that converts the sample material into gaseous or vaporous products that can be burned in the secondary combustion zone.

While various combustion zone designs may be used in practicing the invention, it is preferred to use a generally flame shaped combustion chamber or flask of the type disclosed in my U.S. Pat. No. 3,485,565, or in my pending U.S. application Ser. Nos. 820,269, filed Apr. 29, 1969 now U.S. Pat. No. 3,682,598, and 242,481, filed Apr. 10, 1972 now U.S. Pat. No. 3,830,628. The primary combustion zone 11*a* formed by the illustrative flask 11 is of this general type. The sample basket 10 containing the radioactive nuclide-containing sample material to be burned forms a part of an electrical heating system. To this end, the basket 10 is made of an electrically resistive material such as platinum, so that it functions as an electrical resistive type heating element. A pair of electrical conductors 15 and 16 extend upwardly from a mounting plate 17 to support the basket 10 at its upper and lower ends, while also making electrical contact with the basket to connect it into the electrical heating system. The conductors 15 and 16 extend vertically down through the plate 17 and terminate in depending connector pins which are received by a complementary electrical receptable 18. The receptacle 18, in turn, is connected to an electrical heater circuit including a power source such as battery 20 and a switch 21 for applying an electrical voltage across the basket 10. Thus, the radioactive sample material is heated by simply closing the switch 21, which is opened again as soon as the desired temperature is attained.

In order to facilitate the loading of successive specimens for combustion, the platform 19 is threaded or otherwise secured onto the end of a pneumatic piston rod 22. This rod 22 forms a part of a retracting and elevating mechanism (not shown) which automatically moves the sample basket 10 and mounting plate 17 from a retracted position easily accessible to the operator (not shown in the drawings) to an advanced position within the combustion zone 11*a* (as shown in FIG. 1). In this advanced position, the plate 17 and platform 19 also seal the bottom of the combustion zone 11a.

To promote combustion of the specimen contained in the basket 10, pure oxygen is supplied to the primary combustion zone 11*a* through the conduit 12 and a cooperating passageway 12*a* formed in the platform 19 and the plate 17. The exit end of the passageway 12*a* in the plate 17 is positioned directly beneath the center of the basket 10, so that the oxygen is fed into the combustion zone 11*a* directly beneath the basket 10. The oxygen flow rate is initially adjusted, by suitable valving and flow metering means (not shown), to a level slightly above that required to support stoichiometric combustion of the sample, so that there is a slight excess of oxygen within the combustion zone 11*a*. This excess oxygen together with any of the oxygen required for ideal stoichiometric combustion but not actually used, rises through the combustion zone 11a and is exhausted from the combustion zone through the exhaust port 13 at the top of the chamber along with all the gases, vapors and particulate matter formed from the sample material in the primary zone. A pressurized oxygen supply container (not shown), which functions much like a capacitor, is preferably employed, so that as the demand for oxygen in the primary combustion zone 11*a* diminishes during combustion of the specimen, the oxygen fed to the combustion zone diminishes accordingly.

As mentioned previously, the combustion flask 11 is preferably open at its upper end with its sidewalls extending upwardly and inwardly above the specimen basket 10 so as to approximate the shape of the flame of a burning sample. This configuration advantageously minimizes the volume of oxygen-rich atmosphere, thereby permitting efficient use of the oxygen that is fed into the combustion zone, minimizing the flow of excess oxygen which can cause spillover of $H_2O$ into the $^{14}C$ recovery section and vaporization of the $^{14}C$ trapping agent. With this design, the combustion products tend to be swept directly into the exhaust port 13, with the rising layer of oxygen-rich atmosphere along the flask sidewalls tending to isolate the combustion products from the sidewalls.

Surrounding the combustion flask 11 is a rectangular enclosure 23 which defines an air filled cavity around the outer surface of the flask 11. For proper location of the flask 11 within the enclosure 23, the upper end of the flask meshes with a complementary groove in the fitting 14 containing an O ring seal 14*a*. When it is desired to remove the flask 11 from the enclosure 23, such as for cleaning purposes, a screw clamp 24 is threaded upwardly through a stationary bushing 24*a* to lift the fitting 14 away from the top of the flask.

Prior to combustion of the specimen contained in the basket 10, the air in the cavity between the flask 11 and the enclosure 23 may be heated by means of a heating coil (not shown). The air distributes this heat along the walls of the flask 11 so that the walls are uniformly heated to a temperature above the condensation temperature of the vapors contained in the combustion products to be produced. As described in my prior applications, the pre-heating of the combustion flask walls to maintain the combustion products in gaseous form, combined with the flame-shaped configuration of the flask, permits the combustion products to be exhausted from the combustion zone, on a continuous basis, so efficiently that there is virtually no residue of combustion products deposited on the flask walls. The illustrative system also prevents condensation within the exhaust port 13, since the fitting 14 is also surrounded by the pre-heated air in the cavity between the flask 11 and the surrounding enclosure 23.

If desired, the sample material may be combusted in an open cup-like holder which is placed inside the sample basket 10, with the holder being formed of a material which permits it to slowly and evenly burn during combustion of the starting material. This type of holder is described in more detail in my co-pending application Ser. No. 264,379, filed June 19, 1972 now U.S. Pat. No. 3,849,069.

As disclosed in my U.S. Pat. No. 3,682,598, provision is also preferably made for introducing into the system one or more gasiform oxides of a non-radioactive nuclide which is an isotope of a radioactive nuclide present in the specimen. Thus, where the specimen contains carbon-14 and tritium, either carbon dioxide or water, or both, may be introduced into the system. As the term is used herein, "water" refers to either liquid or gasiform water, although it will be appreciated that at the temperature prevailing within the enclosure 23, typically 150°C., the water exists as water vapor, or steam.

Figure 2:
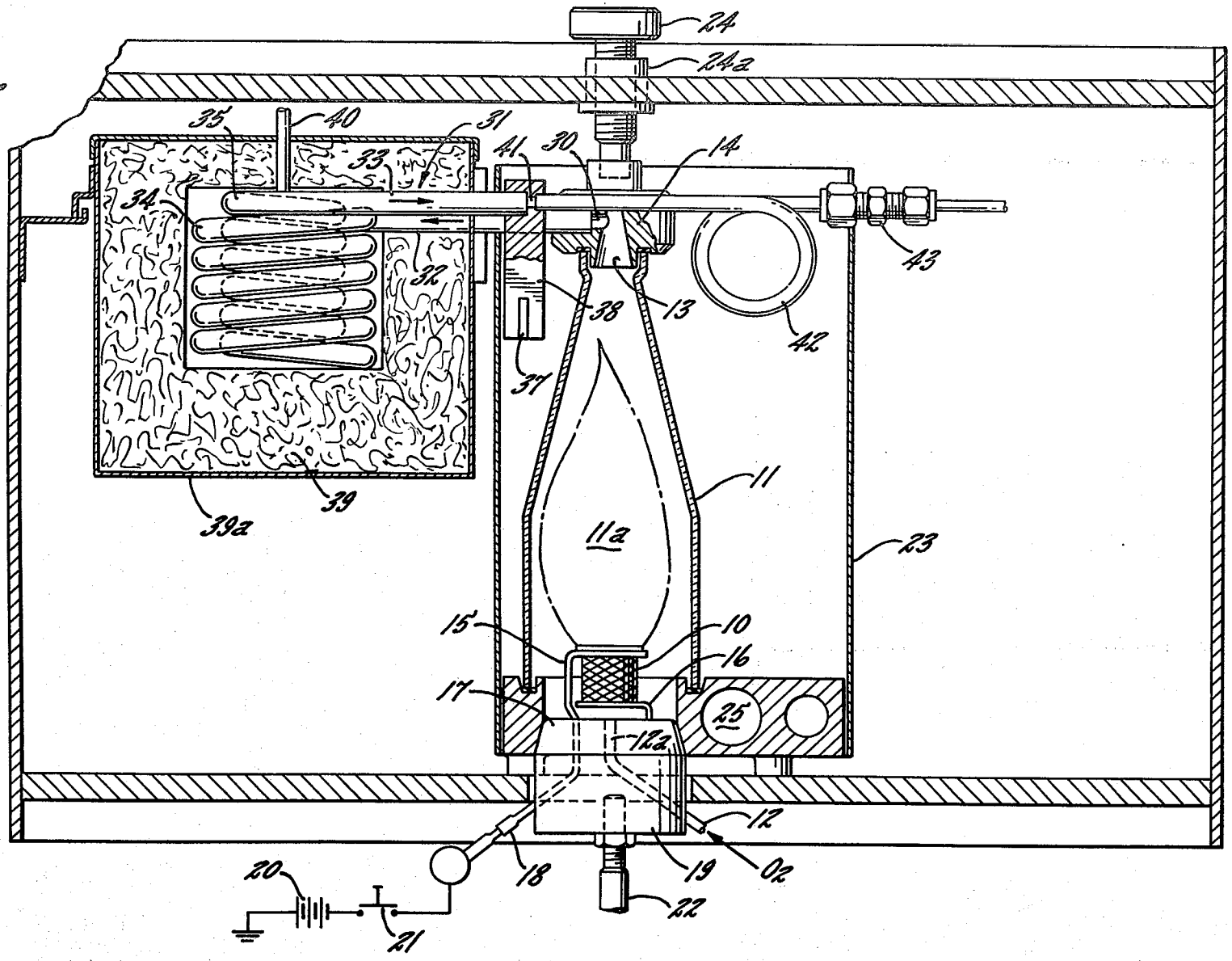
FIG. 2 is a side elevation, partially in section, of the system shown in FIG. 1.

Referring to FIG. 2, water is introduced via the steam generator 25 located near the bottom of the combustion flask 11. Details of construction of an illustrative form of the steam generator 25 have been disclosed in detail in my aforesaid patent application and for this reason need not be repeated here. Suffice it to say that liquid water is drawn from a pressurized water storage container or flask (not shown) and discharged into a heater (also not shown) in which the water is vaporized and from which the vapor is directed into the flask 11. For certain purposes, particularly when the specimen to be combusted is small in size and it is desired to assay for carbon-14, non-radioactive carbon dioxide may be introduced into the combustion zone 11a through a counterpart of the water introduction system described above. As described in my aforementioned patent application, carbon dioxide gas under a pressure higher than that within the flask 11 is discharged into the combustion zone. In the remaining discussion herein it will be appreciated that the injected water and/or carbon dioxide mixes with the combustion products and is carried through the remaining portion of the system. Accordingly, no distinction is hereafter made between the oxides of radioactive and of non-radioactive nuclides.

In accordance with one important aspect of the present invention, the exhaust products from the primary combustion zone are combusted in a secondary zone in which the exhaust products are directed in a helical path so that centrifugal forces drive the exhaust products toward the walls of the secondary zone while intimately mixing the exhaust products with each other to achieve rapid and complete combustion of any uncombusted materials in the secondary zone. Thus, in the illustrative system, the exhaust products flowing through the exhaust port 13 pass through a short lateral passageway 30 formed by the fitting 14 and leading into a heated metallic tube 31 which forms the secondary combustion zone. More specifically, the tube 31 forms a pair of concentric helixes 34 and 35 in series with each other with tangential arms 32 and 33 forming the inlet and outlet ports, respectively, of the secondary combustion zone. As the exhaust gases enter the inlet port formed by the tangential arm 32, the exhaust products flow into the top of the outer helix 34. The exhaust products flow downwardly through this outer helix 34, then radially inwardly to the bottom of the inner helix 35, and then upwardly through the inner helix 35 to the tangential arm 33 that forms the outlet port of the secondary combustion zone at the top of the inner helix 35.

The tube 31 preferably has a cross section that is much smaller than that of the primary combustion zone; for example, suitable tubing has a 5/16 inch outside diameter with a wall thickness of 0.040 inch. Consequently, the helixes 34 and 35 can be formed in a compact space, typically not more than 2 to 3 inches long in any direction. Each helix is also formed with a small radius of curvature, preferably less than about 1.5 inches.

As another feature of the invention, the exhaust products from the primary combustion zone are combusted as they flow through the secondary combustion zone which is heated by passing electrical current directly through the single metallic tube that forms both the helixes 34 and 35 and the two tangential arms 32 and 33. More specifically, a suitable electrical power source is connected to opposite ends of the tube 31 by means of two flexible braided conductors 36 and 37. The first conductor 36 is connected to the inlet end of the metal tube by soldering the conductor 36 directly to the fitting 14 which receives and holds the tangential arm 32 of the metal tube. The second conductor 37 is soldered to a fitting 38 which receives and holds the other arm 33, thereby providing a connection to the outlet end of the tube 31. As electric current is passed through the tube 31 via the conductors 36 and 37, it heats the inside walls of the tube to a temperature sufficiently high to combust the exhaust products flowing therethrough, which typically requires a temperature at least as high as 900°C. The tube 31 must be made of a material that is sufficiently resistant to oxidation at these high temperatures, such as Inconel 600, for example. In order to minimize heat losses from the secondary combustion zone, the helixes 34 and 35 are completely surrounded by thermal insulation 39 contained within a metal housing **39*a*.**

To achieve complete combustion, the secondary combustion zone should be heated to the ignition temperature even before combustion of the sample material is initiated in the primary combustion zone. During heating of the sample material to initiate combustion in the primary combustion zone, portions thereof are immediately converted into gases and vapors which may enter the secondary combustion zone immediately. Heat generated by the combustion process causes the gas pressure within the pirmary zone **11*a* to quickly increase, thereby causing the gases to be rapidly exhausted from the combustion chamber into the helical tube 31. Since the cross-sectional area of the opening in the tube 31 is considerably smaller than the cross section of the primary combustion zone, and the volume of the exhaust gases increases to about four times its original volume due to the rise in temperature, the gas velocity increases significantly as the exhaust gases pass from the primary combustion zone 11a into the secondary zone formed by the tube 31. Consequently, the gases flow through the small diameter tube 31** at a relatively high velocity.

In addition to gases, the exhaust products from the primary combustion zone occasionally contain particulate matter such as soot, as a result of incomplete combustion in the primary zone. To maximize recovery of the radioactive nuclides in the starting material, it is necessary to complete the combustion of this particulate matter as well as any uncombusted gases emanating from the primary combustion zone.

As the exhaust products from the primary combustion zone flow through the tube 31 forming the secondary combustion zone, the helical shape of the tube produces centrifugal forces within the gas stream which drive the exhaust products against the walls of the tube while constantly and thoroughly mixing the gases and any particulate matter entrained therein. This centrifugal action produces rapid and complete reaction of the gases and particulate matter so that the combustion process is completed within a relatively short length of tubing, as will be seen from the specific working examples to be described below. The results achieved with this helical configuration for the secondary combustion zone are particularly striking when compared with other configurations, such as a straight linear tube; whereas the helical tube achieves complete combustion and produces clean combustion products with essentially no remaining soot or unreacted gases, the use of exactly the same tube in a straight linear configuration transmits soot, sparks and flames from the primary combustion zone to the exit end of the tube, indicating incomplete mixing and combustion. Thus, the helical flow path in the secondary combustion zone is considered an important feature of this invention.

Although it is not intended to limit the invention to any particular theory, it is believed that gases and entrained particulate matter flowing through the helical tube are continually centrifuged toward the tube wall at the outer diameter of the helix. Thus, the gases and particulate material are brought into direct contact with the heated walls of the tube to achieve effective heat exchange between the tube walls and the materials flowing therethrough. The flow rate near the walls of the tube is slower than the flow rate in the center of the tube, thereby further enhancing heat exchange between the tube walls and the materials flowing therethrough. It is believed that the gases and particulate material near the tube walls flow circumferentially around the tube while flowing axially therethrough so that these materials are continually re-entrained in the high velocity flow stream in the center of the tube and re-centrifuged toward the outer tube walls at the outer edge of the helix. Thus, there is continuous and intimate intermixing combined with highly efficient heat transfer, resulting in rapid and complete combustion.

In order to maintain the secondary combustion zone at the selected temperature, which in the illustrative embodiment is typically 900°–1000°C., a thermocouple 40 is located at the center of the inner helix 35. This thermocouple is connected to a conventional temperature controller in circuit with the power supply connected to the conductors 36 and 37, so that the current fed to the helical tube 31 is automatically adjusted to maintain the walls of the tube at the selected temperature.

It has been found that the combustion system provided by this invention is capable of achieving complete combustion of even the most difficult sample materials without any preliminary preparation of the sample materials. As a result of the complete combustion, the radioactive nuclide-containing materials recovered from the combustion products are completely transparent, so that there is no color quenching in the resultant liquid scintillation samples during subsequent measurement of the radioactivity level of such samples.

The sample material is 100 percent combusted and, with most sample materials, over 99 percent of the radioactive nuclide can be recovered with a memory reduced an order of magnitude below the memory level of presently available flame combustion systems; for example, the memory from a typical sample combustion is reduced from about 0.05 percent to about 0.005 percent. Moreover, this complete combustion can be achieved at high fluid flow rates, e.g., on the order of 5 liters per minute, so that each combustion cycle is carried out in a short time interval, e.g., 0.05 milliliter of organic solvents such as toluene can be combusted in less than 30 seconds.

For the purpose of cooling the combustion products before they enter the recovery system, the exhaust products from the secondary combustion zone flow through a port 41 in the fitting 38 and on into a cooling coil 42. In the illustrative system, this coil 42 is formed by two helical windings in a single metal tube located in the upper region of the housing 23. As the combustion products pass through the coil 42, their temperature is quickly reduced, but not enough to condense any of the components of the exhaust stream. That is, the combustion products are all still in the gaseous state when they enter the trapping system via a reducing coupling 43 connected to the outlet end of the coil 42.

To demonstrate the excellent mixing and combustion characteristics of this invention, it was used in the combustion of $^{14}C$-labelled methane, which is the most stable natural combustible gas. In dilute concentration, it is resistive to decomposition, is most difficult to combust thoroughly, and has one of the highest ignition temperatures. Methane has a spontaneous ignition temperature of 632°C., and the lowest concentration (volume per unit volume) at which it can normally be burned in oxygen is $5.4 \times 10^{-2}$. The complete combustion of methane involves over twenty different chemical reactions, some of which require atomic oxygen or other intermediate reaction products which are rare in the gas stream when it contains only a low concentration of methane. When the illustrative system of the present invention was used to combust $^{14}C$-labelled methane at 925°C. in a concentration of $5 \times 10^{-3}$, 100% of the $^{14}C$ was converted to $^{14}CO_2$ and more than 99 percent of the $^{14}C$ was recovered in the collection vial (the major portion of the final 1 percent was discharged in the cleaning cycle, and the balance was exhausted as unrecovered vapor, retained as "memory", or recovered as "spillover" in the tritium collection vial). The same degree of recovery (more than 99 percent) was also achieved at 1050°C. in a concentration of $1 \times 10^{-7}$. These results are especially striking in view of the fact that the methane was combusted on a batch basis, i.e., a given quantity of methane was introduced prior to combustion, so that as the combustion progressed the methane concentration diminished. It is estimated that the actual average methane concentration was only $1 \times 10^{-8}$. Thus, if the recovery was in excess of 99 percent, the maximum fraction of unrecovered methane was less than 1 percent of $10^{-8}$, or $1 \times 10^{-10}$.

The combustion of methane described above represents a worst case example. That is, the combustion system of this invention can be used to combust virtually all other organic compounds at lower temperatures and/or shorter times than methane. Also, hydrogen or tritium can be combusted at temperatures 100°C. to 200°C. lower than the temperatures required for carbon.

The following examples will further illustrate the results achieved by the use of this invention with a variety of different sample materials.

EXAMPLE 1

Using a system of the type illustrated in the drawings, 200 milligrams of carbon-14 palmitic acid were combusted in a flask about 5½ inches high with a bottom inside diameter of 2 inches and a top inside diameter of ½ inch. The flask was preheated to 150°C., and pure oxygen was fed to the flask at an initial rate of 4 l./min. and decreased exponentially with time to a minimum of about 1 l./min. The secondary combustion zone was formed by a 5-foot tube of Inconel 600 having an outside diameter of 5/16 inch and a wall thickness of 0.040 inch, and forming an outer helix about 2 inches long with an outer diameter of 2½ inches and an inner helix about 2 inches long with an outer diameter of 1¾ inches. The tube was heated to a temperature of 950°C. by passing 70 amperes of current through the entire length of the tube at a voltage of 5 volts. Using the trapping system of a commercial Model 306 Sample Oxidizer made by Packard Instrument Company, Inc., the recovery of carbon-14 was 99.3 percent with a memory of less than 0.004 percent and spillover of 0.002 percent.

EXAMPLE 2

The same equipment and conditions described in Example 1 were used to combust 200 milligrams of tritiated palmitic acid. The recovery of tritium was 99.3 percent with a memory of less than 0.004 percent and spillover so small that it could not be measured.

EXAMPLE 3

Using the same equipment and conditions as in Example 1, 2 grams of fresh tritiated rat liver were combusted. The recovery of tritium was 99 percent with a memory of 0.02 percent and negligible spillover. The collected samples were completely transparent, which means that they would produce no color quenching when counted.

EXAMPLE 4

The same equipment and conditions used in Example 1 were used to combust 0.5 grams of pig carcass containing carbon-14 toluene. The recovery of carbon-14 was 99 percent with 0.03 percent memory and negligible spillover. The exhaust products from the primary combustion zone were very smoky, which would normally produce darkly colored samples. However, the samples actually collected from the exhaust products from the secondary combustion zone were completely transparent.

EXAMPLE 5

Using the same equipment and conditions as in Example 1, 50 microliters of tritiated toluene in gelatin capsules were combusted. The recovery of tritium was 99 percent with 0.02 percent memory and negligible spillover.

EXAMPLE 6

Using the same equipment and conditions as in Example 1, 50 microliters of carbon-14 toluene in gelatin capsules were combusted. The recovery of carbon-14 was 99 percent with 0.02 percent memory and negligible spillover.

I claim as my invention:

1. A process for combusting materials containing radioactive nuclides to permit recovery of the radioactive nuclides, said process comprising the steps of combusting a sample material containing at least one radioactive nuclide in a primary combustion zone, and continuously exhausting said primary combustion zone and passing the exhaust products through a secondary combustion zone while combusting uncombusted materials remaining in said exhaust products within said secondary zone, said exhaust products being directed in a helical path in the secondary combustion zone so that centrifugal forces drive the exhaust products toward the walls of the secondary combustion zone while intimately mixing the exhaust products with each other to achieve rapid and complete combustion of said uncombusted materials in said secondary zone.

2. A combustion process as set forth in claim 1 wherein said secondary combustion zone is formed by a helical tube which is heated to combust the exhaust products passing therethrough.

3. A combustion process as set forth in claim 2 wherein said helical tube is a metal tube which is heated by passing an electric current through the walls thereof.

4. A combustion process as set forth in claim 1 wherein said helical path has a radius of curvature of less than about 1.5 inches.

5. A combustion process as set forth in claim 1 wherein said secondary combustion zone is heated to a temperature at least as high as 900°C.

6. A combustion process as set forth in claim 1 wherein the combustion products formed in said secondary combustion zone are continuously removed from said secondary zone.

7. A combustion process as set forth in claim 1 wherein said sample material contains at least one radioactive nuclide selected from the group consisting of tritium and carbon-14.

8. A combustion process as set forth in claim 1 wherein substantially pure oxygen is supplied to said primary combustion zone during the combustion of said sample material therein.

9. A process for combusting materials containing radioactive nuclides to permit recovery of the radioactive nuclides, said process comprising the steps of combusting a sample material containing at least one radioactive nuclide selected from the group consisting of tritium and carbon-14 in a primary combustion zone while supplying substantially pure oxygen to said primary combustion zone, at an initial oxygen flow rate of at least 5 liters per minute, continuously exhausting said primary combustion zone and passing the exhaust products through a helical tube while heating said tube to a temperature of at least 900°C. to combust uncombusted materials remaining in said exhaust products within said secondary zone, the helical path of said exhaust products through said tube producing centrifugal forces to drive the exhaust products toward the walls of said tube while intimately mixing the exhaust products with each other to achieve rapid and complete combustion of said uncombusted materials in said secondary zone, said helical tube having a radius of curvature of less than about 1.5 inches, and continuously removing the combustion products from said helical tube and cooling said combustion products.

10. Combustion apparatus comprising the combination of a primary combustion zone having means for combusting a sample material placed therein and means for continuously exhausting said primary zone, and a secondary combustion zone for receiving the exhaust products from said primary chamber, said secondary zone including means for combusting uncombusted materials remaining in said exhaust products in said secondary zone, and means for directing said exhaust products in a helical path in the secondary combustion zone so that centrifugal forces drive the exhaust products toward the walls of the secondary combustion zone while intimately mixing the exhaust products with each other to achieve rapid and complete combustion of said uncombusted materials in the secondary zone.

11. Combustion apparatus as set forth in claim 10 wherein said secondary combustion zone comprises a helical tube and means for heating said tube to combust uncombusted materials in the exhaust products passing therethrough.

12. Combustion apparatus as set forth in claim 11 wherein said helical tube is metal, and said means for heating said tube comprises an electric power source connected to said tube for passing electric current therethrough.

13. Combustion apparatus as set forth in claim 11 wherein said helical path has a radius of curvature of less than about 1.5 inches.

14. Combustion apparatus as set forth in claim 11 wherein said helical tube comprises a single tube forming a relatively large diameter helix at the inlet end thereof and a relatively small diameter helix at the outlet end thereof, said small diameter helix being disposed inside said large diameter helix.

15. Combustion apparatus as set forth in claim 10 which includes a heat exchanger connected to said secondary combustion chamber for cooling the combustion products discharged therefrom.

16. Combustion apparatus as set forth in claim 10 which includes means for supplying substantially pure oxygen to said primary combustion chamber during the ignition and combustion of said sample material therein.

* * * * *